United States Patent [19]

Koch

[11] Patent Number: 4,705,153

[45] Date of Patent: Nov. 10, 1987

[54] COIN ACCEPTOR FOR VENDING MACHINE

[75] Inventor: Frank J. Koch, Ogdensburg, N.Y.

[73] Assignee: DeFelsko Corporation, Ogdensburg, N.Y.

[21] Appl. No.: 812,506

[22] Filed: Dec. 23, 1985

[51] Int. Cl.[4] ..... G07D 5/04; G07F 11/04

[52] U.S. Cl. ..... 194/277; 177/51; 194/339

[58] Field of Search ..... 194/225, 232, 261, 277, 194/339, 340; 177/51

[56] References Cited

U.S. PATENT DOCUMENTS

| | | | |
|---|---|---|---|
| 13,840 | 11/1855 | Allender | 177/51 |
| 216,184 | 6/1879 | Hoag | 177/51 |
| 494,653 | 4/1893 | Smith | 194/268 |
| 1,442,941 | 1/1923 | Grover | 194/251 |
| 1,798,172 | 3/1931 | Seitz | 194/229 |
| 2,076,299 | 4/1937 | Kloess | 194/261 |
| 2,256,486 | 9/1941 | Lindberg | 194/294 |
| 2,339,823 | 1/1944 | Vogel | 194/332 |
| 2,370,869 | 3/1945 | McKay | 194/340 |
| 2,708,499 | 5/1955 | Patzer | 194/321 |
| 4,190,145 | 2/1980 | Paret | 194/339 |

FOREIGN PATENT DOCUMENTS

| | | | |
|---|---|---|---|
| 6863 | of 1890 | United Kingdom | 194/339 |

*Primary Examiner*—F. J. Bartuska

*Attorney, Agent, or Firm*—Burns, Doane, Swecker & Mathis

[57] ABSTRACT

A coin acceptor includes first and second members initially spaced apart from one another and frictionally carrying a third member. Moving the first and second members toward one another displaces the third member a distance corresponding to the weight of the coin selectively positioned on the third member. The distance which the third member is displaced is compared with a reference position.

28 Claims, 9 Drawing Figures

COIN ACCEPTOR FOR VENDING MACHINE

BACKGROUND AND SUMMARY OF THE PRESENT INVENTION

The present invention relates generally to mechanisms for receiving coins in vending machines and more particularly relates to mechanisms for vending machines wherein the weight of the coin is compared against a reference standard.

Numerous devices are known for receiving coins especially for use in vending machines. Typically, such devices include slots or passageways within which the coin rolls. If the coin has sufficient mass, the coin can successfully traverse a series of check points in order to permit the vending machine to open or otherwise dispense its contents. Representative examples of such coin acceptors for vending machines are disclosed in U.S. Pat. No. 494,653 of Smith; U.S. Pat. No. 1,442,941 of Grover; U.S. Pat. No. 1,798,172 of Seitz; U.S. Pat. No. 2,076,299 of Kloess; U.S. Pat. No. 2,256,486 of Lindberg; U.S. Pat. No. 2,339,823 of Vogel; U.S. Pat. No. 2,370,869 of McKay; U.S. Pat. No. 2,708,499 of Patzer; and U.S. Pat. No. 4,190,145 of Paret. More recently, such mechanisms have become increasingly complex and costly with many current mechanisms including complicated electronic circuitry and sensing devices.

In addition to the coin acceptors for vending machines, devices have been created for testing coins by way of gravity as on a balance beam. Examples of such devices include U.S. Pat. No. 13,840 of Allender and U.S. Pat. No. 216,184 of Hoag.

The need remains, however, for a coin acceptor especially for use in a vending machine which is simple in design and construction, dependable in operation and relatively inexpensive. For example, vending machines which dispense relatively inexpensive items such as newspapers, maps, and even somewhat more expensive items such as cigarettes, must be durable yet relatively inexpensive in order to profitably permit the wide distribution of such vending machines.

Accordingly, it is an object of the present invention to provide a coin acceptor especially for use in a vending machine which is relatively simple in configuration yet durable and reliable in operation.

Another object of the present invention is to provide a coin acceptor for a vending machine which utilizes sliding friction in order to determine whether a proper coin or coins have been deposited.

Yet another object of the present invention is to provide a coin acceptor for a vending machine which utilizes sliding friction in order to compare the weight of the coin or coins deposited in the vending machine with a reference standard.

These and other objects of the present invention are realized by the apparatus and method according to the present invention wherein a coin acceptor includes first and second members which frictionally carry a third member. Means are provided for moving the first and second members toward one another. The weight of the coin or coins deposited on the third member causes the third member to be displaced a distance corresponding to the weight of the coin. In the preferred embodiment, if the third member has been displaced a predetermined amount, the coin acceptor will permit the vending machine or similar device to be opened or to otherwise dispense the contents of the vending machine.

BRIEF DESCRIPTION OF THE DRAWINGS

The preferred embodiments of the present invention will be described with reference to the accompanying drawings wherein like members bear like reference numerals and wherein.

DETAILED DESCRIPTION OF A PREFERRED EMBODIMENT

Figure 1:
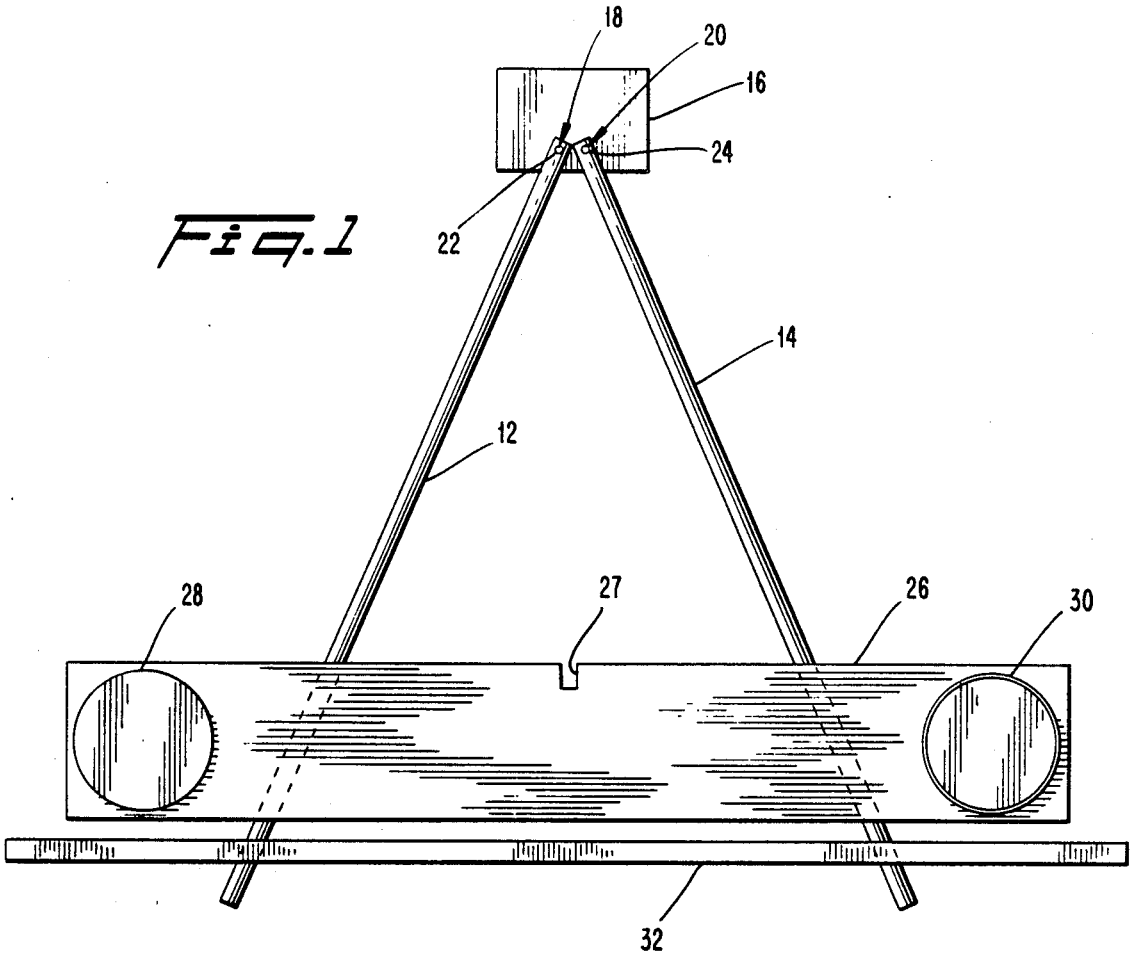
FIG. 1 is a top view of a coin acceptor according to the present invention in an initial configuration.

With reference now to FIG. 1, a coin acceptor according to the present invention includes first and second members 12, 14 which are spaced apart from one another in an initial configuration. In the preferred embodiment, the members 12, 14 are metal rods (for example of brass) which are pivotably mounted at one end to a support 16. The pivotal connection 18, 20 of the rods 12, 14 may be accomplished, for example, by a pin 22, 24 which is received within a passageway provided in a first end of each of the rods 12, 14. The pivot points 18, 20 are positioned adjacent to one another but are sufficiently spaced apart so as to permit the rods 12, 14 to be moved freely toward and away from one another.

A third member 26 is carried by the first and second rods 12, 14 in the initial configuration with the third member being frictionally engaged by an upper surface of the first and second rods 12, 14. The third member 26 comprises a bar (for example of metal) having a sufficient length so as to extend beyond the spaced apart ends of the rods 12, 14 and having sufficient width so as to be frictionally engaged by the rods 12, 14. The third member may be provided with a slot 27 which may be compared with a reference position whereby the distance which said third member has been displaced may be determined.

A reference member 28 is provided at one end of the bar 26 with a coin to be tested 30 provided at the other end of the bar 26. A fourth member 32 is provided for moving the first and second rods 12, 14 toward one another with the result that the bar 26 is displaced a distance proportionate to the weight of the coin 30 relative to the reference weight 28.

Figure 2:
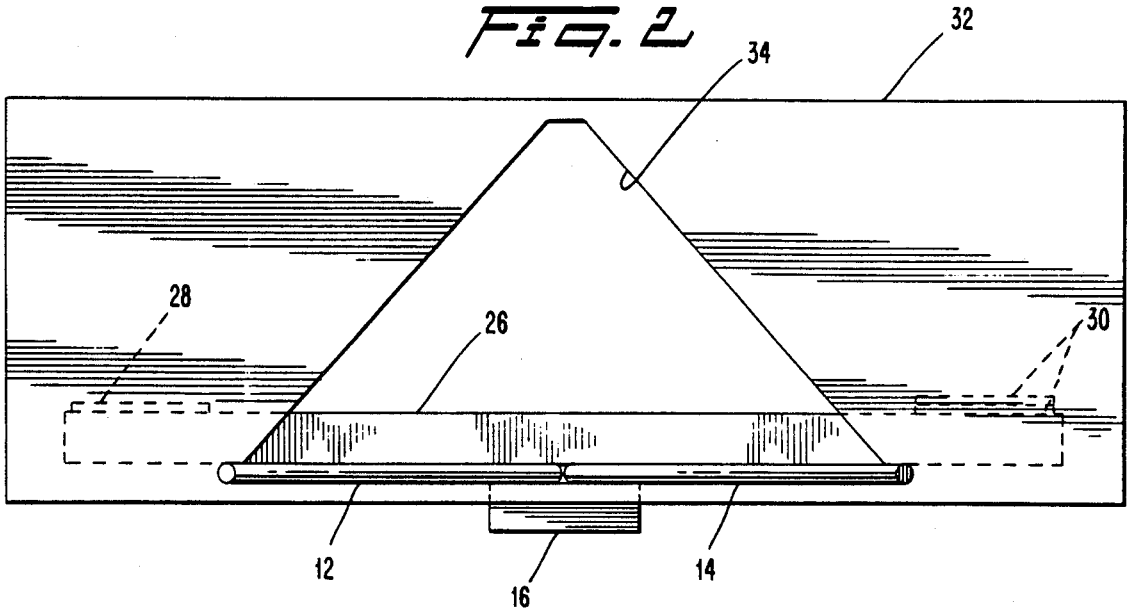
FIG. 2 is a side view of the coin acceptor of FIG. 1.

With reference now to FIG. 2, the member 32 is provided with a triangular slot 34 with the rods 12, 14 extending through the triangular slot 34.

Figure 3:
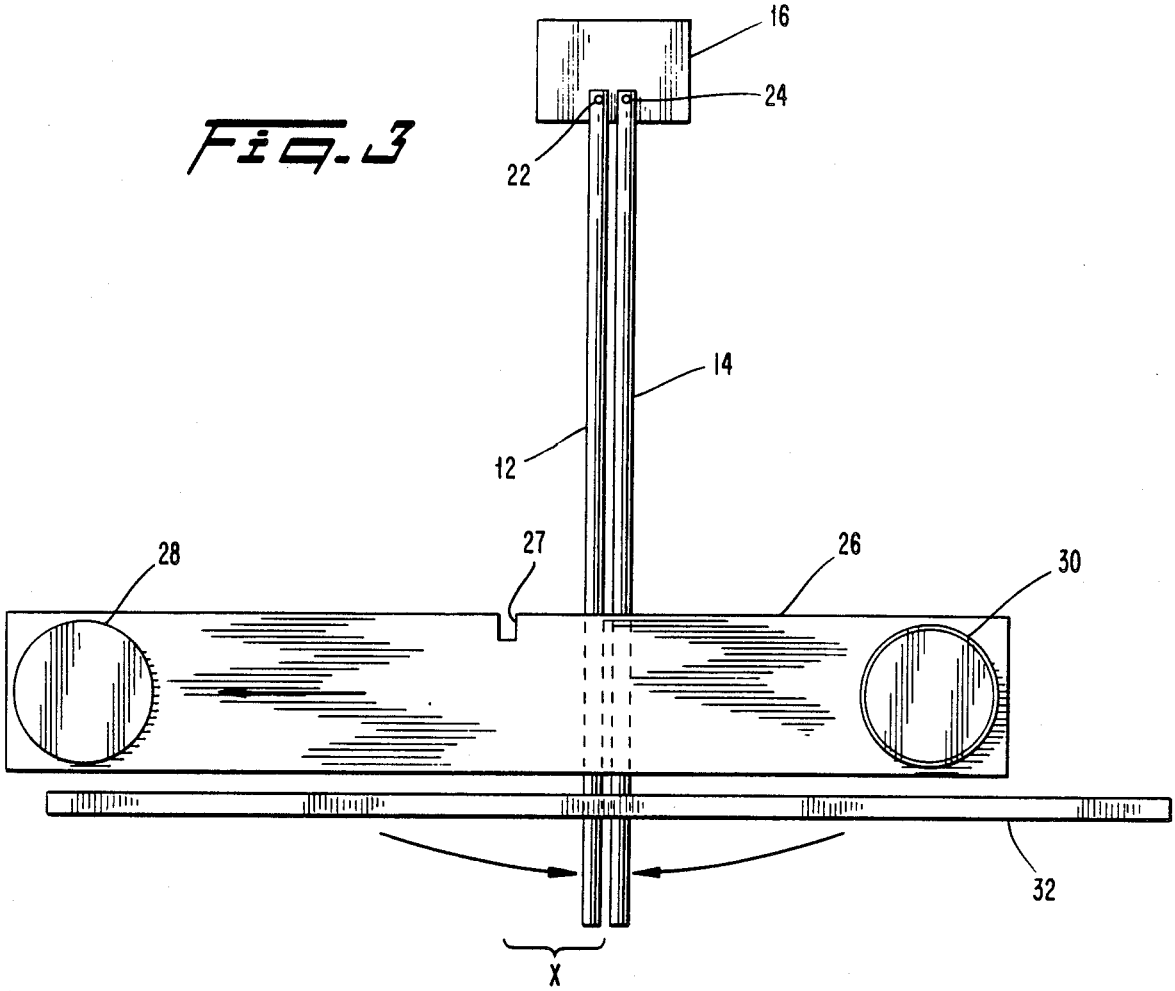
FIG. 3 is a top view of the coin acceptor of FIG. 1 in a subsequent configuration.
Figure 4:
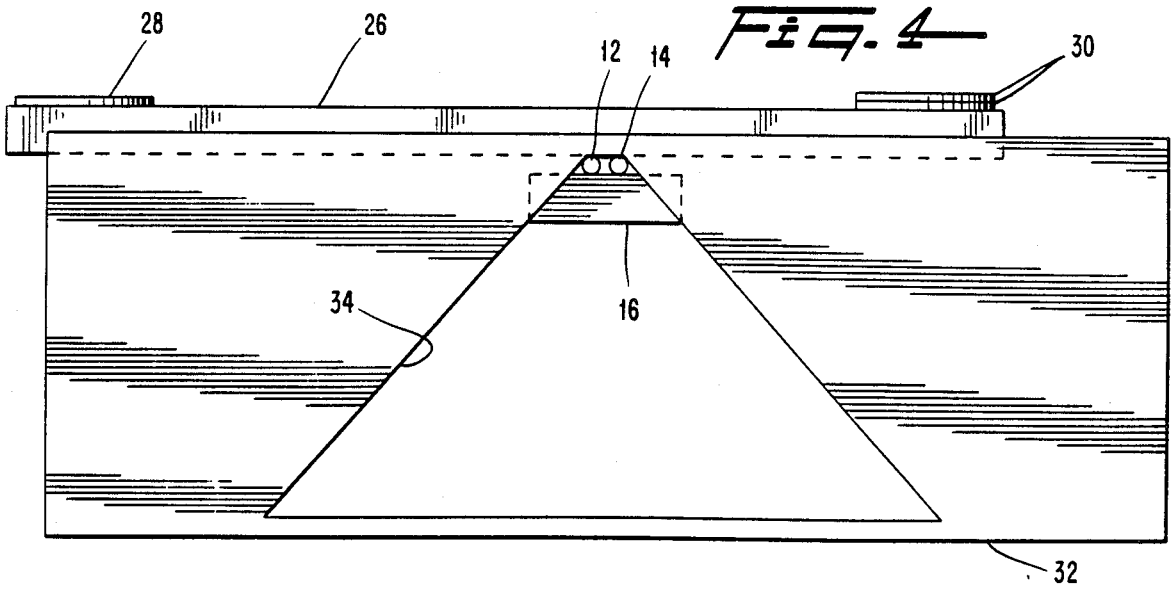
FIG. 4 is a side view of a coin acceptor of FIG. 3.

With reference now to FIG. 3, the panel 32 has been moved vertically downwardly to urge the rods 12, 14 toward one another. Consequently, the bar 26 has been displaced a distance X which corresponds to the ratio of the weight of coins 30 with respect to the reference weight 28. In the embodiment illustrated in FIGS. 1–4, the coins 30 weigh twice as much as the reference standard 28 and the bar 26 was initially equally spaced with respect to the rods 12, 14. Consequently, the friction between the bar 26 and the rod 14 was greater than the friction between the bar 26 and the rod 12 with the result that the bar 26 was moved to the left as shown in FIG. 3. More precisely, the distance which the bar 26 is displaced to the left in FIG. 3 corresponds to the difference in weight of the left and right portions of the bar 26 with the coins or other weights provided thereon. Therefore, if the bar 26 were not initially centered on the rods 12, 14 and if the bar 26 has sufficient mass so as not to be negligible, the difference in weight of the left side of the bar 26 as compared with the right side of the bar 26 (assuming that the bar is not centered on the rods 12, 14) will affect the distance that the bar 26 is displaced upon movement of the rods 12, 14 toward one another.

In the preferred embodiment, the bar 26 is initially centered on the rods 12, 14 and the mass of the bar 26 is not significantly greater than the weight of the reference standard 28 and coins 30.

As will be readily obvious to one skilled in the art, the reference weight 28 can be eliminated or replaced by a portion of the bar 26 if so desired.

Figure 5:
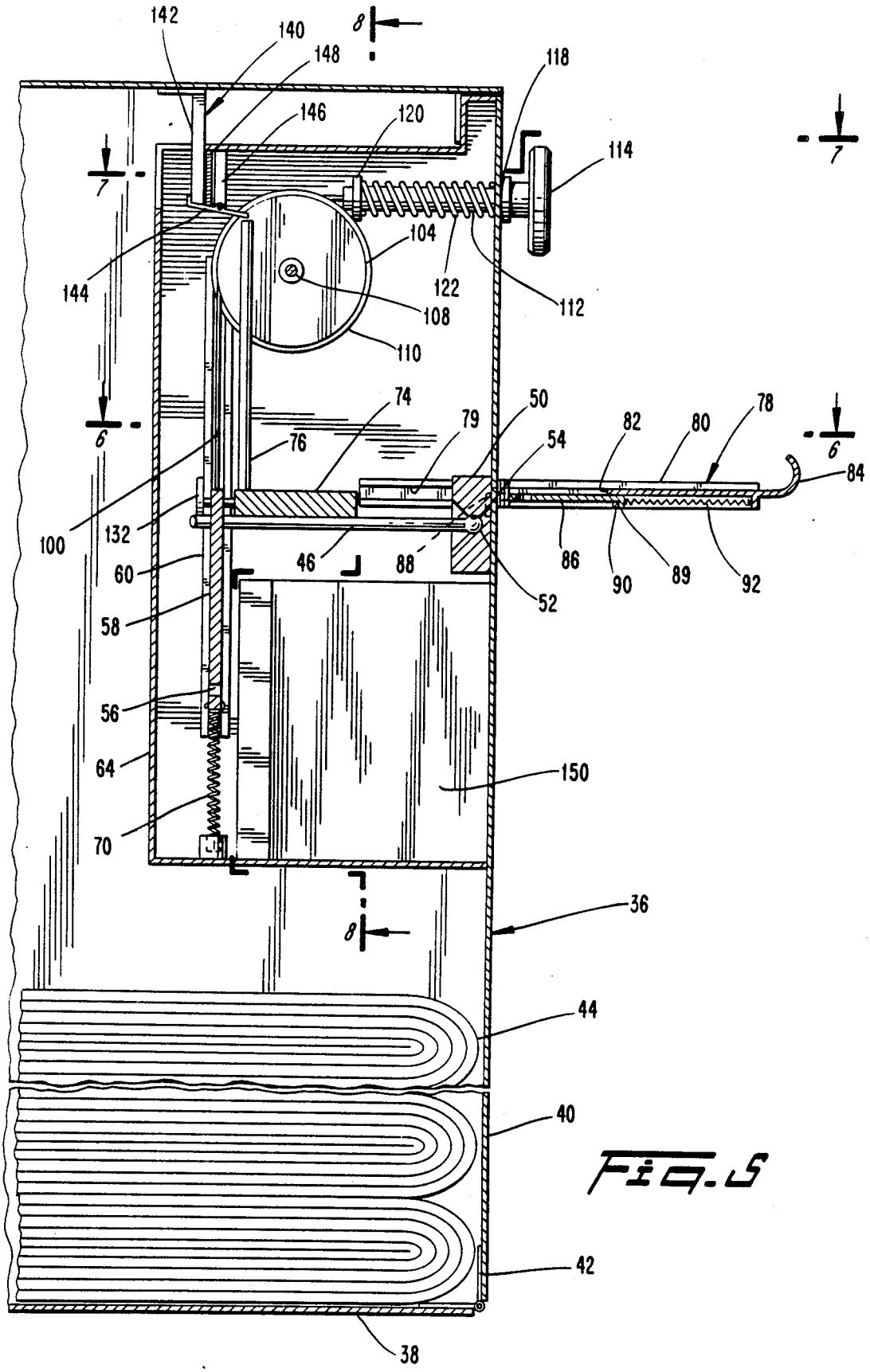
FIG. 5 is a cross-sectional view of a vending machine including the coin-acceptor according to the present invention.

With reference now to FIG. 5, the coin acceptor according to the present invention is provided in a vending machine 36 which includes a housing 38 and a door 40. The door 40 is pivotably connected to the housing 38 by a hinge 42 provided along a lowermost edge of the door 40.

The vending machine 36 of the preferred embodiment dispenses newspapers 44 which are provided in a lower chamber of the interior of the vending machine 36. It will be readily obvious to one skilled in the art that the coin acceptor for a vending machine according to the present invention can be adapted for and utilized in a wide variety of vending machines other than those for newspapers and the like. For example, the coin acceptor of the vending machine can be readily adapted for use in dispensing candy, cigarettes, soda pop and other articles which are commonly dispensed in vending machines.

In the coin acceptor of FIG. 5, a pair of rods 46, 48 are pivotably mounted in a support 50 which is fixed to the door 40 of the vending machine. The rods 46, 48 have generally spherical ends 52 which are received within a socket 54 of the support 50. The socket 54 is configured so as to allow the rods 46, 48 to be moved freely toward one another in a horizontal plane and also to permit the rods 46, 48 to be pivoted upwardly and downwardly a limited extent.

Figure 6:
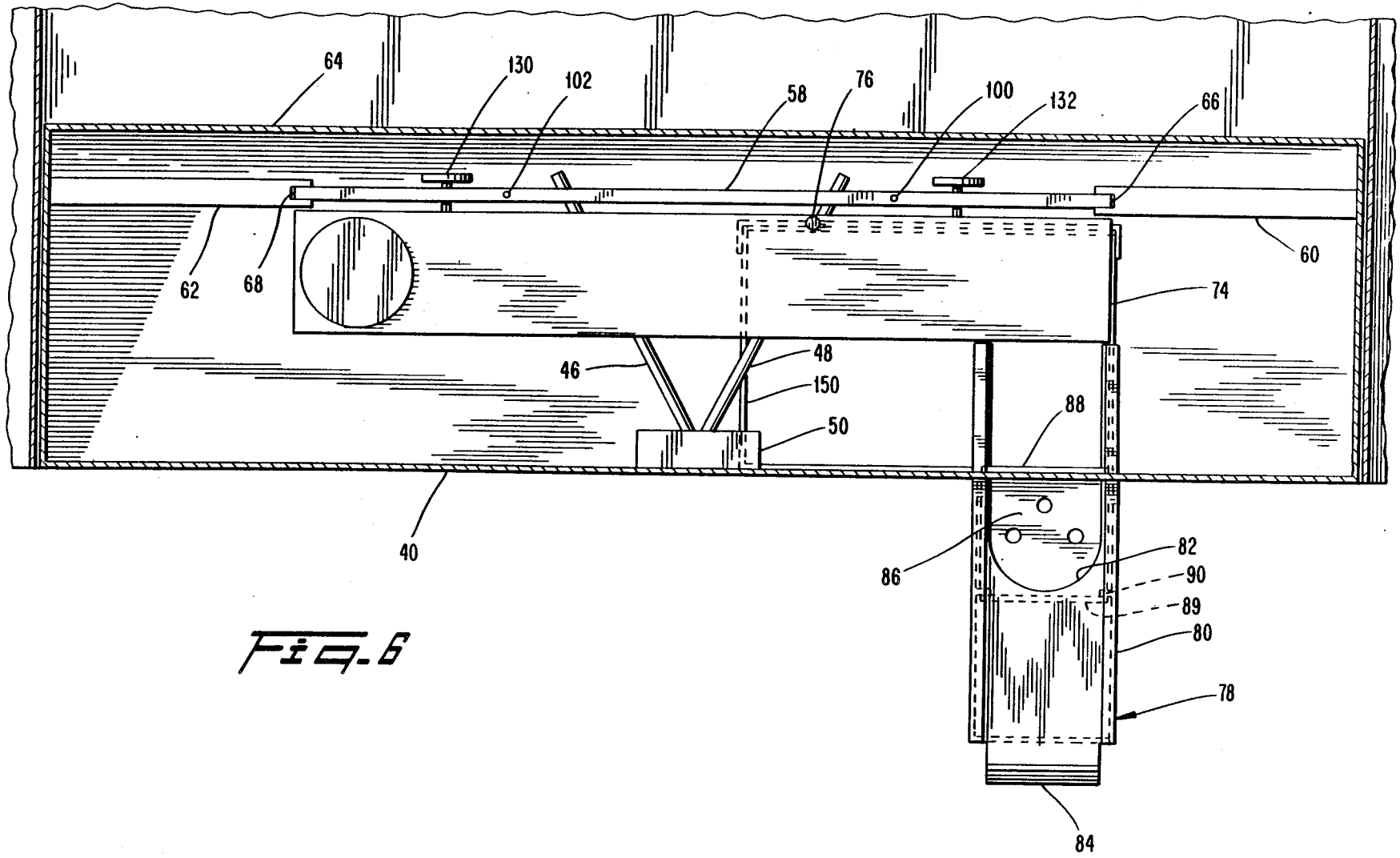
FIG. 6 is a view along the line 6—6 of FIG. 5.

The rods 46, 48 (see also FIG. 6) extend substantially horizontally through an opening 56 in a third member 58. The opening 56 comprises a V-shaped slot having sufficient width so as to permit the rods 46, 48 to slide freely within the slot 56. The member 58 comprises a flat panel which is slidably received within two brackets 60, 62 which are rigidly fixed to a housing 64 that is attached to the door 40. Each of the brackets 60, 62 is provided with a channel 66, 68 which slidably receives a corresponding edge of the panel 58. The panel 58 is resiliently attached to a lower wall of the housing 64 by a pair of springs 70, 72. The springs 70, 72 are sufficiently resilient to return the panel 58 to an initial configuration but permit the panel 58 to be moved vertically upon actuation of the vending mechanism.

As will be readily obvious to one skilled in the art, the rods 46, 48 could be mounted parallel to one another (for example in tracks and not pivotably mounted) for sliding movement toward and away from one another. In addition, the first and second members could be shorter than the width of the third member and could carry the third member on edges if desired. Moreover, the fourth member 58 could be replaced by slots formed by a plurality of wires (not shown) which are moved toward and away from one another. Alternatively, the first and second members could be moved toward and away from one another by arms (not shown) or in other suitable ways so as to accomplish the present invention.

With reference again to FIG. 5, a bar 74 is frictionally engaged by an upper surface of the rods 46, 48 and is carried by the rods 46, 48. The bar 74 is generally flat in configuration and the rods 46, 48 and the bar 74 correspond to the rods 12, 14 and the bar 26 of FIG. 1. The bar 74 is provided with a pin 76 which extends vertically with respect to the bar 74.

Figure 7:
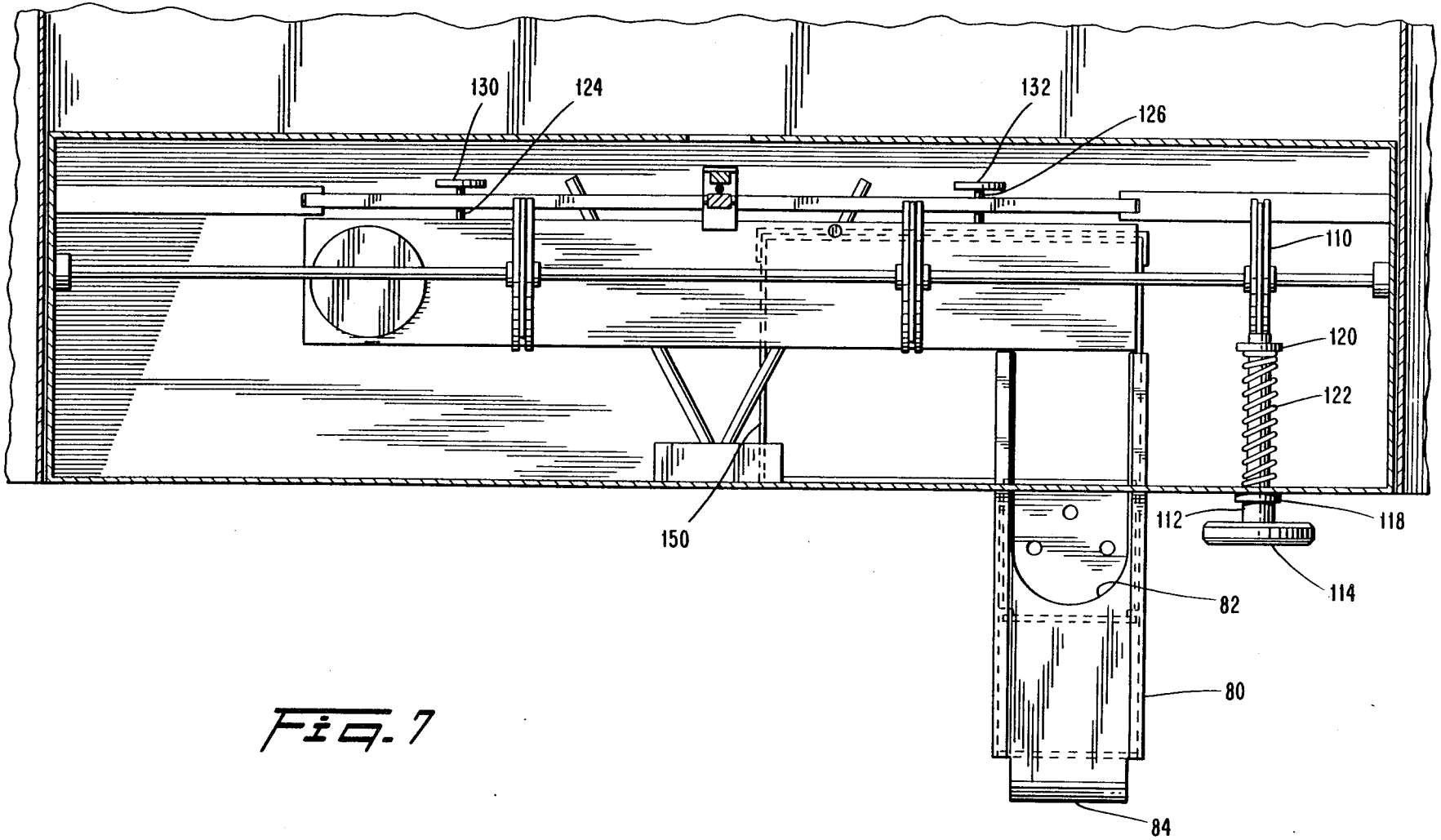
FIG. 7 is a view along the line 7—7 of FIG. 5.

A mechanism 78 is provided for selectively positioning at least one coin on the bar 74. The mechanism 78 provides a channel 79 which slidably receives a coin holder 80 having a U-shaped slot 82 (see FIG. 7). The coin holder 80 has a handle 84 which extends a predetermined distance beyond the U-shaped slot 82. A coin support 86 is carried by the coin holder 80 on the underside thereof with the coin support 86 including a first shoulder 88 at one end which abuts the door 40 of the vending machine 36 and a second shoulder 89 which abuts a stop 90 of the coin holder 80. The coin support 86 is resiliently urged toward the door 40 by a spring 92. The mechanism 78 is positioned and configured so that a coin which is selectively positioned in the U-shaped slot 82 can be urged toward the bar 74 manually by an individual. As the coin and coin holder 80 are urged toward the door, the coin support 86 is likewise moved beneath the coin holder 80 so as to support the coin until the coin holder 80 reaches the bar 74. The coin support 86 is prevented by the stop 89 which abuts the door 40 of the vending machine from continuing the entire distance with the coin holder 80.

The panel 58 is carried by two cables 100, 102 which are carried on respective pulleys 104, 106. The pulleys 104, 106 are carried on a common shaft 108 with the pulleys 104, 106 fixed with respect to the shaft 108. The ends of the cables 100, 102 are fixed at a suitable position on the circumference of the pulleys 104, 106. A third pulley 110 is also fixedly mounted on the shaft 108 (see FIG. 7). A spring biased rod 112 having a knob 114 is connected to a cable 116 which passes over the circumference of the pulley 110. The rod 112 is provided with a first stop 118 which limits the movement of the rod 112 toward the door 40 and a second stop 120 which secures the spring 122 between the stop 120 and the door 40 and also prevents the rod 112 from being pulled beyond a predetermined distance relative to the door 40.

Figure 8A:
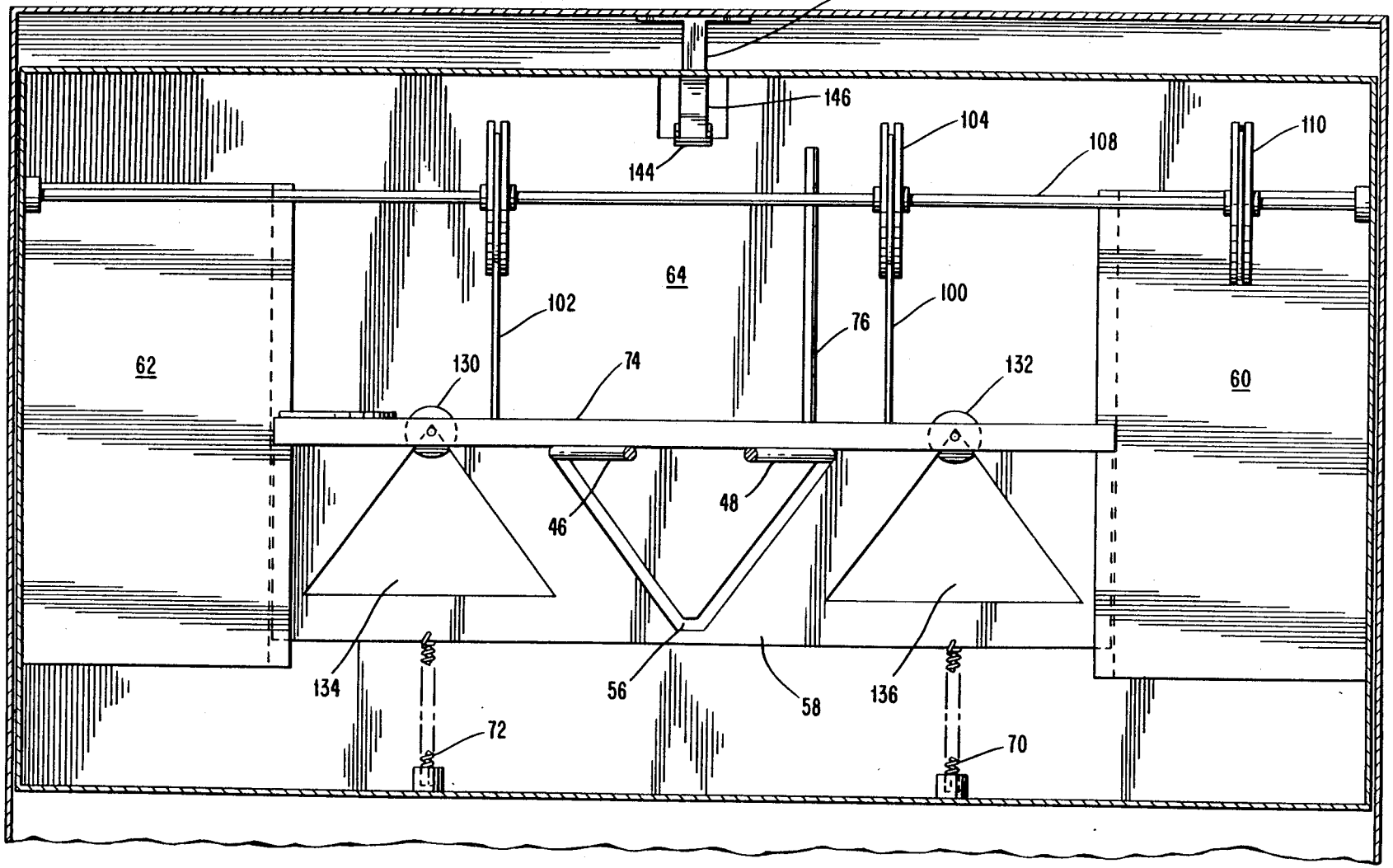
FIG. 8*a* is a view along the line 8—8 of FIG. 5 in an initial configuration.
Figure 8B:
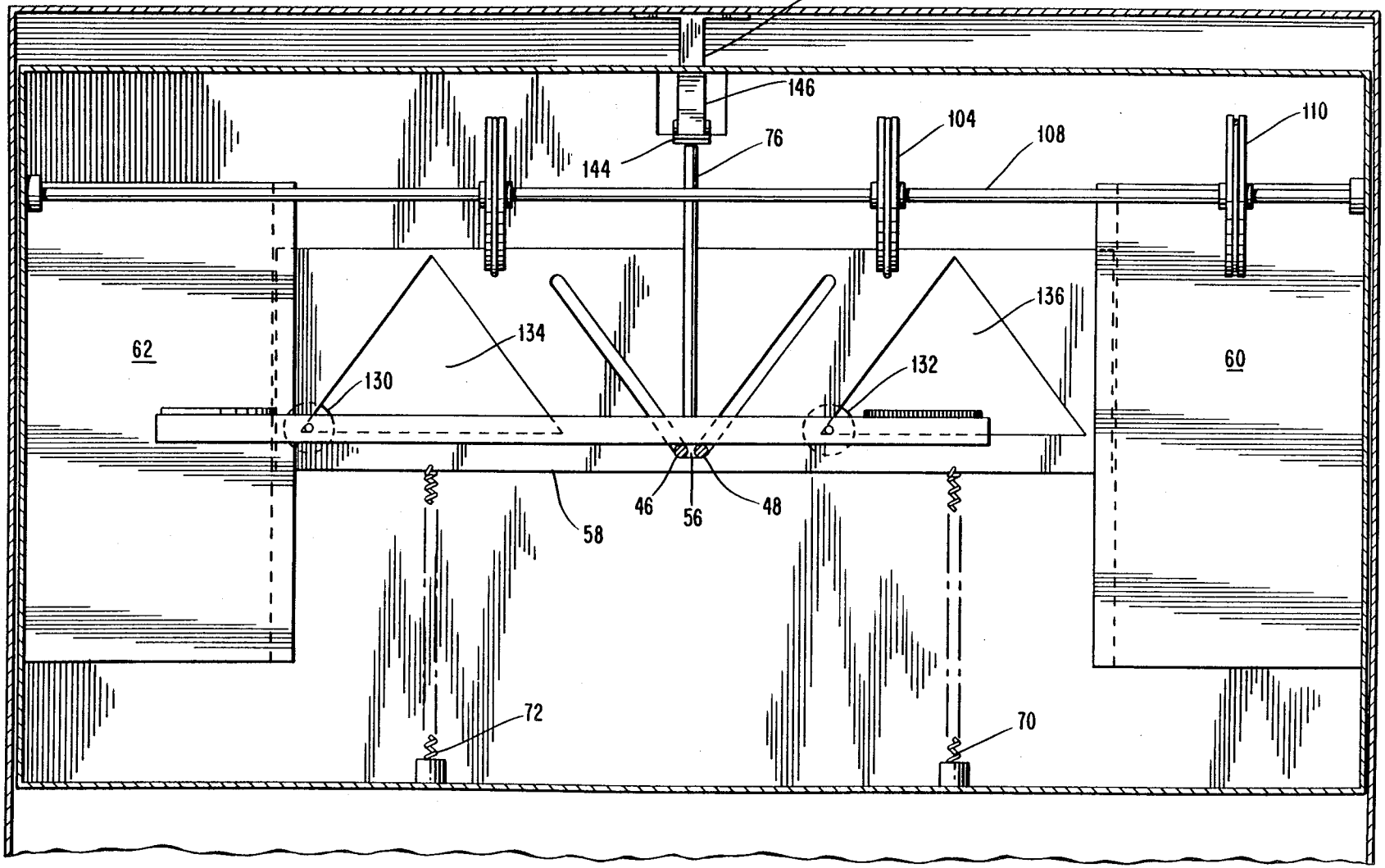
FIG. 8*b* is a view along the line 8—8 of FIG. 5 in a subsequent position.

The bar 74 is provided with two pins 124, 126 (see FIG. 6) which extend through the panel 58. The pins 124, 126 have buttons 130, 132 which help to maintain the bar 74 in the predetermined configuration with respect to the panel 58. With reference to FIGS. 8*a* and 8*b*, the pins 124, 126 are received within triangular passageways 134, 136 provided in the panel 58.

With reference again to FIG. 5, a latch mechanism 140 for the door 40 includes a catch 142 which is fixedly mounted on the top portion of the housing 38 so as to extend into the coin acceptor housing 64 through an opening in the housing when the door 40 is in a closed configuration. A pivotably mounted catch 144 is carried by a support 146 which is fixedly mounted to an upper portion of the housing 64. A spring 148 maintains the catch 144 in an upwardly biased configuration so that the catch 144 remains securely engaged with the catch 142 when the door 40 is in the closed configuration. The pin 76 of the bar 74 is positioned so that it will engage an end of the catch 144 when the bar 74 has been displaced to a preselected position in the manner described. A coin box 150 is provided beneath the bar 74 to receive the coins which have been selectively positioned on the bar 74 after the coin acceptor mechanism has been actuated.

In operation, the coin acceptor mechanism is configured in the initial position as shown in FIG. 5. An individual positions a coin such as a quarter in the U-shaped slot of the coin holder 80 and then urges the coin holder 80 inwardly toward the bar 74. The coin is pushed onto the top surface of the bar 74 and the coin holder 80 is then retracted. While the coin holder 80 is pushed inwardly, the coin support 86 prevents the coin from falling downwardly into the coin box 150 while the coin is being moved onto the bar 74. The individual then pulls the knob 114 so as to rotate the pulleys 104, 106 and 110. Rotation of the pulleys 104, 106 pulls the panel 58 upwardly so as to urge the rods 46, 48 toward one another. The bar 74 is then displaced laterally, a position which corresponds to the weight of the coin with respect to a reference standard provided on the other end of the bar 74. When the rods 46, 48 have reached the bottom of the V-shaped slot 56, further pulling of the knob 114 causes the rods 46, 48 and the bar 74 to move upwardly a slight amount. If the bar 74 has been displaced to a predetermined position, the pin 76 will be positioned immediately beneath a projecting end of the catch 144. Further pulling of the knob 114 will cause the pin 76 to release the latch 140 as the door is opened. Accordingly, by pulling on the knob 114, the movement of the rods toward one another, the displacement of the bar 74 and the release of the latch 140 are accomplished in one step. As the door is pivoted downwardly, the coin will slide off of the bar 74 into the coin collection box 150. It should be noted that the reference standard should be securely fixed to the bar 74 so as to prevent the reference standard from falling into the collection box 150. Furthermore, a keyed passageway (not shown) may be provided for periodically selectively removing the coins from the coin collection box 150. If the bar 74 has not been displaced to the preselected position (for example because the coin was too heavy or too light), the rod 76 will not engage the catch 144 to release the latch. The bar 74, rods 46 and 48 and pin 76 will pivot upwardly a sufficient amount, however, so as to cause the coin to nevertheless drop into the coin box 150.

Upon release of the knob 114, the springs 70 and the spring 122 will cause the panel 58 to move downwardly. Movement of the panel 58 downwardly will cause the rods 46, 48 to move apart from one another to the initial configuration and will also cause the bar 74 to return to the initial configuration. The pins 122, 124 will be engaged by the surfaces of the triangular passageways 134, 136 to displace the bar 74 to the initial configuration. The passageways 134, 136 are sufficiently wide so as not to obstruct the displacement of the bar 74 on the rods 46, 48 regardless of the weight of the coin which is provided on the bar 74.

Variations and changes to the present invention will become readily apparent to one skilled in the art upon reading the present specification. Thus it is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions and all changes or variations which fall within the meaning and range of the claims are therefore intended to be embraced thereon.

What is claimed is:

1. A device for testing an object, comprising:

first and second members spaced apart from one another in an initial configuration;

a third member having the object selectively positioned thereon, said third member being carried by said first and second members with said third member being frictionally engaged by an upper surface of said first and second members;

means for moving said first and second members toward one another whereby the third member is displaced a distance corresponding to the relative friction between the third member and each of the first and second members, said relative friction corresponding to the weight of the object; and means for comparing the distance which said third member is displaced with a reference position.

2. The device of claim 1 wherein one end of each of said first and second members is pivotally mounted on a support with the other ends of the first and second members initially spaced apart from one another in said initial configuration.

3. The device of claim 2 wherein said first and second members are rods and wherein said third member is a bar.

4. The device of claim 1 wherein said means for moving said first and second members toward one another includes a fourth member which is moved generally perpendicular with respect to the first and second members to move the first and second members toward one another.

5. The device of claim 4 wherein said first and second members are rods and wherein said third member is a bar and wherein said fourth member comprises a generally flat panel which is moved vertically to move said first and second members toward one another.

6. The device of claim 5 wherein the first and second members are engaged by a V-shaped surface of said fourth member.

7. A coin acceptor for a vending machine, comprising:

first and second members spaced apart from one another in an initial configuration;

a third member carried by said first and second members with said third member being frictionally engaged by an upper surface of said first and second members;

means for selectively positioning at least one coin on said third member;

means for moving said first and second members toward one another whereby the third member is displaced a distance corresponding to the relative friction between the third member and each of the first and second members;

means for comparing the distance which said third member is displaced with a reference position; and means for vending an article when said third member is displaced to a predetermined position relative to said reference position.

8. The coin acceptor of claim 7 wherein one end of each of said first and second members is pivotally mounted on a support with the other ends of the first and second members initially spaced apart from one another in said initial configuration.

9. The coin acceptor of claim 8 wherein said first and second members are rods and wherein said third member is a bar.

10. The coin acceptor of claim 7 wherein said means for moving said first and second members toward one another includes a fourth member which is moved generally perpendicular with respect to the first and second members to move the first and second members toward one another.

11. The coin acceptor of claim 10 wherein said first and second members are rods and wherein said third member is a bar and wherein said fourth member comprises a generally flat panel which is moved vertically to move said first and second members toward one another.

12. The coin acceptor of claim 11 wherein the first and second members are engaged by a V-shaped surface of said fourth member.

13. The coin acceptor of claim 7 wherein said means for comparing the distance which said third member is displaced with a reference position includes a pin which extends from said third member.

14. The coin acceptor of claim 7 wherein said means for comparing the distance which said third member is displaced with a reference position includes a slot provided in said third member.

15. The coin acceptor of claim 13 wherein said means for vending an article comprises a latch which is released by said pin.

16. The coin acceptor of claim 15 further comprising means for returning said first and second members to said initial configuration.

17. The coin acceptor of claim 16 further comprising means for returning said third member to said initial configuration.

18. The coin acceptor of claim 17 further comprising means for removing said coin from said third member after the distance which was displaced has been compared with said reference position.

19. A method for testing an object, comprising:

spacing first and second members apart from one another in an initial configuration;

carrying a third member by said first and second members in said initial configuration with said third member being frictionally engaged by an upper surface of said first and second members;

selectively positioning the object on the third member;

moving said first and second members toward one another whereby the third member is displaced a distance corresponding to the relative friction between the third member and each of the first and second members, said relative friction corresponding to the weight of the object; and comparing the distance which said third member is displaced with a reference position.

20. The method of claim 19 wherein said first and second members are moved horizontally toward one another by a fourth member which is moved perpendicularly to said first and second members.

21. The method of claim 20 wherein the step of selectively positioning comprises selectively positioning at least one coin on said third member prior to moving said first and second members toward one another.

22. The method of claim 21 further comprising the step of vending an article when said third member is displaced to a predetermined position relative to said reference position.

23. The method of claim 22 wherein said article is vended by releasing a latch.

24. The method of claim 22 further comprising the step of returning said first and second members to said initial configuration.

25. The method of claim 24 further comprising the step of returning said third member to said initial configuration.

26. The method of claim 25 further comprising the step of removing said coin from said third member after comparing the distance which the third member has been displaced with said reference position.

27. A device for testing an object, comprising:

first and second members spaced apart from one another in an initial configuration;

a third member having the object selectively positioned thereon, said third member being supported by said first and second members with said third member being frictionally engaged by an upper surface of said first and second members;

means for moving said first and second members toward one another whereby relative movement between the third member and each of the first and second members corresponds to the relative friction between the third member and each of the first and second members, said relative friction corresponding to the weight of the object; and means for comparing the relative movement with a reference position.

28. The device of claim 27, wherein one end of each of said first and second members is pivotally mounted on a support with the other ends of the first and second members initially spaced apart from one another in said initial configuration.

* * * * *